US005554063A

United States Patent [19]

Millay et al.

[11] Patent Number: 5,554,063

[45] Date of Patent: Sep. 10, 1996

[54] CENTERLESS GRINDER HAVING INSIDE DIAMETER SIZE CONTROL AND METHOD THEREFOR

[75] Inventors: Lawrence I. Millay, Springfield, Vt.; Richard E. Crossman, Leicester, Mass.

[73] Assignee: Bryant Grinder Corporation, Springfield, Vt.

[21] Appl. No.: 285,348

[22] Filed: Aug. 3, 1994

[51] Int. Cl.[6] ..... B24B 49/00; B24B 51/00

[52] U.S. Cl. ..... 451/9; 451/10; 451/27; 451/51; 451/61; 451/180; 451/407

[58] Field of Search ..... 451/8, 9, 10, 27, 451/51, 61, 180, 242, 407

[56] References Cited

U.S. PATENT DOCUMENTS

| | | | |
|---|---|---|---|
| 3,323,258 | 6/1967 | Terp et al. | 451/242 |
| 3,594,959 | 7/1971 | Collin | 451/242 |
| 3,657,843 | 4/1972 | Uhtenwoldt et al. | 451/242 |
| 3,908,315 | 9/1975 | Schaller . | |
| 4,055,027 | 10/1977 | Freddi . | |
| 4,112,629 | 9/1978 | Possati | 451/27 |
| 4,223,484 | 9/1980 | Giardino et al. | 451/27 |
| 4,586,295 | 5/1986 | Ishii . | |
| 4,712,332 | 12/1987 | Smith . | |
| 5,025,592 | 6/1991 | Yamamori et al. . | |
| 5,108,117 | 4/1992 | Crossman et al. | 279/126 |
| 5,123,213 | 6/1992 | Vinson . | |
| 5,193,314 | 3/1993 | Wormley et al. . | |
| 5,231,798 | 8/1993 | Judge et al. . | |
| 5,285,599 | 2/1994 | Lessway | 451/51 |

*Primary Examiner*—Timothy V. Eley
*Attorney, Agent, or Firm*—Hamilton, Brook, Smith & Reynolds, P.C.

[57] ABSTRACT

A centerless grinding machine comprises a stationary disk, a following disk, and a shoe, which cooperate to hold and rotate a workpiece. The following disk is mechanically loaded to the bias towards the stationary disk and the shoe so that the workpiece is secured between an outer circumference of the disks and the shoe. A diameter detector detects an outside diameter of the workpiece by detecting a displacement of the following disk by the workpiece. From this information, a controller controls an X-Z grinder to grind an inner surface of the workpiece. This grinding is in response to the outside detector detected by the diameter detector. As a result, the inner diameter can be machines to closer tolerances than are available in the outer diameter.

20 Claims, 4 Drawing Sheets

CENTERLESS GRINDER HAVING INSIDE DIAMETER SIZE CONTROL AND METHOD THEREFOR

BACKGROUND OF THE INVENTION

Most internal and external grinding machines hold the workpiece in a rotating chuck. Grinding wheels or abrasive films held in shoes are then brought in contact with the inner or outer surfaces of the workpiece to smooth and finish these surfaces.

Centerless grinding refers to a broad class of metal removal techniques in which a generally cylindrical workpiece is both supported and rotated by two wheels or disks. In some configurations, one of the wheels is a regulating wheel which has an outer surface with a high coefficient of friction. The second disk is a grinding wheel which usually has a grit surface. The grinding wheel and the regulating wheel are rotated so that the surface velocity of the faces of each wheel is different. Since the surface of the regulating wheel has a high coefficient of friction, the workpiece tends to rotate with the regulating wheel but slide over the grinding wheel to the extent of the differences in surface velocities of the wheels. This sliding causes the slow gradual removal of metal along the outer circumference of the workpiece.

In other centerless grinding machines, a workpiece is held and rotated between two drive rollers which rotate with the same surface velocities. An abrasive element such as an abrasive film supported by a polishing shoe is then brought into contact with the outer surface of the workpiece to smooth the outer surface of the rotating workpiece. Still, other centerless grinding machines are adapted to remove material along an internal surface of the workpiece. These workpieces usually have a cylindrical inner bore into which a grinding head is introduced to smooth the surface of the bore.

SUMMARY OF THE INVENTION

One problem associated with the centerless grinding machines stems from the fact that the workpiece is supported on its outside diameter between two rotating rollers which creates difficulties in achieving an internal diameter size of the workpiece as outside diameter size irregularities affect the position of the workpiece. Therefore, when an inner surface must be ground down to specific tolerances, there are few accurate techniques for assessing the dimensions of the workpiece. Larger internal diameters can be sized by using an electronic or air/electronic gage during the grind operation. This option, however, is not available on smaller workpieces where there is insufficient clearance.

The present invention is generally directed to centerless grinding machines in which the workpiece dimensions are detected indirectly by detecting the displacement of the disks holding the workpiece. The detected dimensions can then be used to control the grinding of the surfaces to within required tolerances for the inner diameter, for example.

In general, according to one aspect, the invention features a centerless grinding machine. This machine comprises a disk for rotating a workpiece, a shoe, and a workpiece support element which cooperate to hold the workpiece during rotation. A diameter detector is provided to detect an outside diameter of the workpiece. From this information, a grinder grinds an inner surface of the workpiece during the rotation. This grinding is performed under control of a controller in response to the detected outside diameter.

In specific embodiments, the disk is mechanically loaded to maintain engagement with the workpiece so that the workpiece is secured between an outer circumference of the disk and the shoe. In other embodiments, the diameter detector detects the outside diameter by sensing the displacement of the disk and controls the grinder to machine the inner surface of the workpiece to achieve a desired wall thickness which is determined in response to the outside diameter detected by the diameter detector. Additionally, workpiece support element can be another disk that cooperates with the disk and the shoe to hold the workpiece.

In general, according to another aspect, the invention features a centerless grinding machine which comprises a stationary disk, a following disk, and a shoe. The stationary disk, the following disk, and the shoe cooperate to hold and rotate a workpiece. A diameter detector detects an outside diameter of the workpiece by detecting a displacement of the following disk by the workpiece. A controller then controls a grinder to grind a surface of the workpiece. This grinding is in response to the magnitude of the displacement of the following disk detected by the diameter detector.

In general, according to still another aspect, the invention features a method for controlling a grinding machine which includes a disk, a shoe, and a workpiece support element which cooperate to hold and rotate the workpiece, and a grinder for grinding an inner surface of the workpiece during the rotation. This inventive method comprises first determining an outside diameter of the workpiece by detecting displacement of the disk. From this information, a necessary wall thickness is calculated which will yield the desired inner diameter. Then, the grinder is operated to remove material along the inner surfaces of the workpiece to achieve the calculated wall thickness.

In specific embodiments, the outside diameter is determined by sensing the displacement of the disk.

In general, according to still a further aspect, the invention features a centerless grinding machine. This machine comprises a first stationary workpiece support element, a second stationary workpiece support element, and a following workpiece support element which are adapted to cooperate to hold and rotate a workpiece. A diameter detector detects an outside diameter of the workpiece by detecting displacement of the following workpiece support element by the workpiece. From this information, a grinder grinds an inner surface of the workpiece during the rotation while a controller controls the grinder in response to the outside diameter detected by the diameter detector.

In specific embodiments, the first and second stationary workpiece support elements are a stationary disk and a shoe, respectively, while the following workpiece support element is a following disk.

In other embodiments, the grinder comprises: a grinding head, a motor for rotating the grinding head, a z-stage for plunging the grinding head into the workpiece, and an x-stage for bringing the grinding head into engagement with the inner surface of the workpiece.

The above and other features of the invention including various novel details of construction and combinations of parts, and other advantages, will now be more particularly described with reference to the accompanying drawings and pointed out in the claims. It will be understood that the particular method and device embodying the invention is shown by way of illustration and not as a limitation of the invention. The principles and features of this invention may be employed and various and numerous embodiments without the departing from the scope of the invention.

BRIEF DESCRIPTION OF THE DRAWINGS

In the accompanying drawings, like reference characters refer to the same parts throughout the different views. The drawings are not necessarily to scale, emphasis instead being placed upon illustrating the principles of the invention. Of the drawings.

DETAILED DESCRIPTION OF THE DRAWINGS

Figure 1:
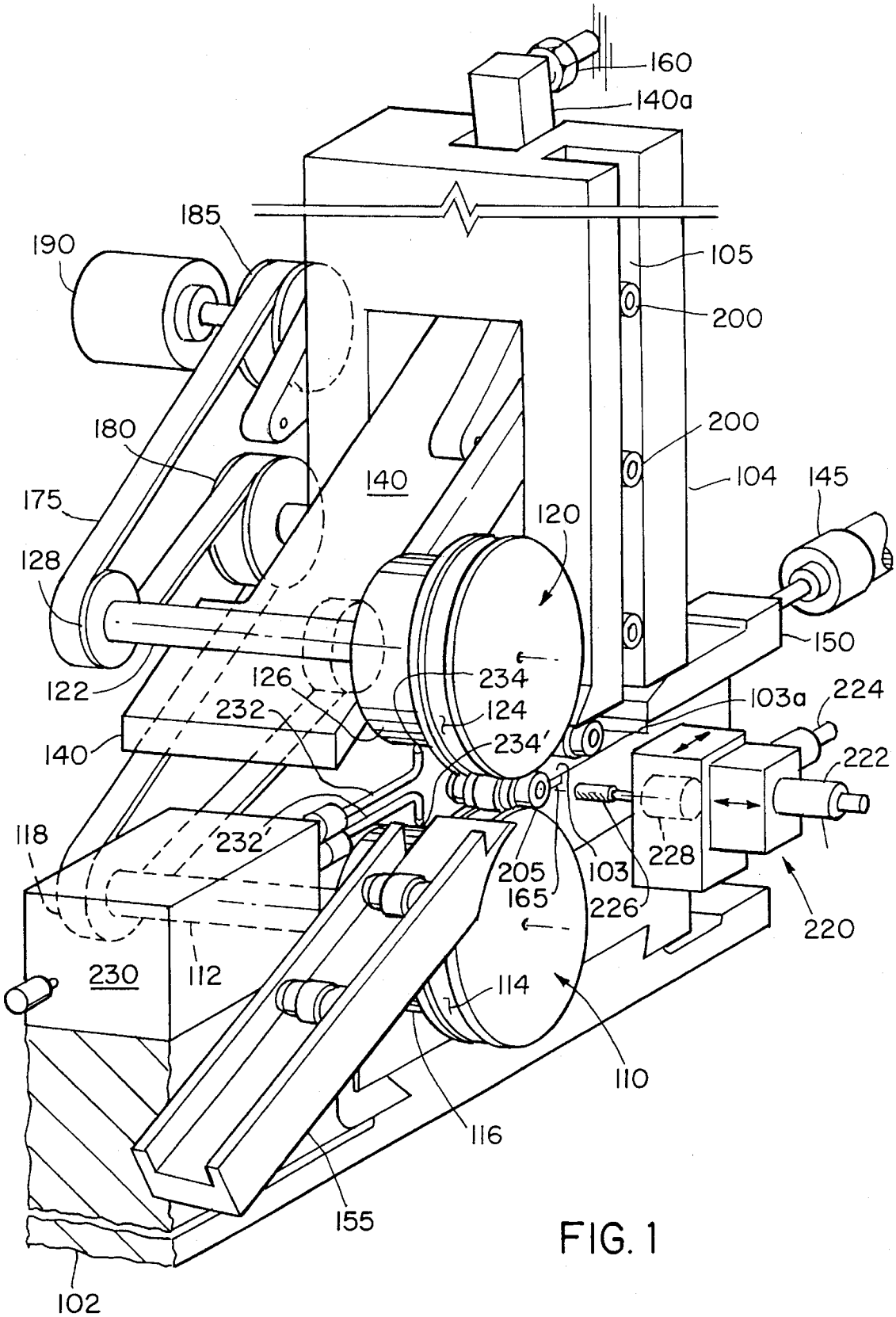
FIG. 1 is a perspective view of a centerless grinding machine of the present invention.

Turning now to FIG. 1, the overall organization of centerless grinding machine constructed according to the principles of the invention is illustrated. Specifically, the centerless grinding machine generally comprises a lower frame 102, which serves as a base for the machine, and an upper frame 104, which projects vertically from the lower frame 102.

A stationary disk 110 is vertically oriented and positioned on a lateral side of the lower frame 102 to serve as a first stationary workpiece support element. A drive shaft 112 of the stationary disk 110 is journaled to the lower frame 102 by bearings, not shown, to enable the free rotation of the stationary disk. A following disk 120 is also vertically oriented and is positioned directly above the stationary disk 110 and serves as a following workpiece support element. A drive shaft 122 of the following disk 120 is journaled to a support arm 140 which is adapted to pivot on the upper frame 104.

New workpieces 200 are received into the machine via a vertical chute 105 formed in the upper frame 104. The vertical chute terminates in a horizontal inlet track 103 of the lower frame 102. As better shown in FIG. 2, workpieces falling down the chute 105 rest at the distal end 103*a* of the inlet track 103 until the machining of the workpiece 205 currently held between the two disks 110, 120 has been concluded. On this event, a linear actuator 145 pushes an ejector 150 to the left in FIGS. 1 and 2. As a result, the new workpiece, which is resting at the distal end 103*a* of the inlet track, is pushed along the track 103 until it engages the outer circumference of a working surface 124 of the following disk 120. The ejector 150 continues to push the new workpiece so that the following disk is pivoted upward away from the stationary disk 110 and simultaneously the new workpiece pushes the finished workpiece down an outlet ramp 155.

The support arm 140 comprises a lever arm 140*a* which is engaged by a piston 160 biased outwardly by a compression spring or hydraulically. As a result, the following disk 120 is mechanically loaded downward so that it resiliently pivots into engagement with the workpiece 205. Thus, the new workpiece is held in a stable position between the following disk 120, stationary disk 110, and a shoe 165, which extends from a bottom surface of the inlet track 103 and serves as a second stationary workpiece support element. The shoe 165 is usually made from tungsten carbide so that it is resistant to wear and provides a smooth surface against which the workpiece 205 can slide.

The specific workpiece support elements shown, i.e., the shoe 165, the stationary disk 110, and the following disk 120, do not represent the only possible configuration. For example, additional shoes could be substituted for either stationary disk 110 or the following disk 120. Similarly, the shoe 165 could be replaced with a passive or driven disk. The basic issue is simply that the workpiece 205 must be supported by at least three elements so that it can be stably held during grinding.

Figure 3:
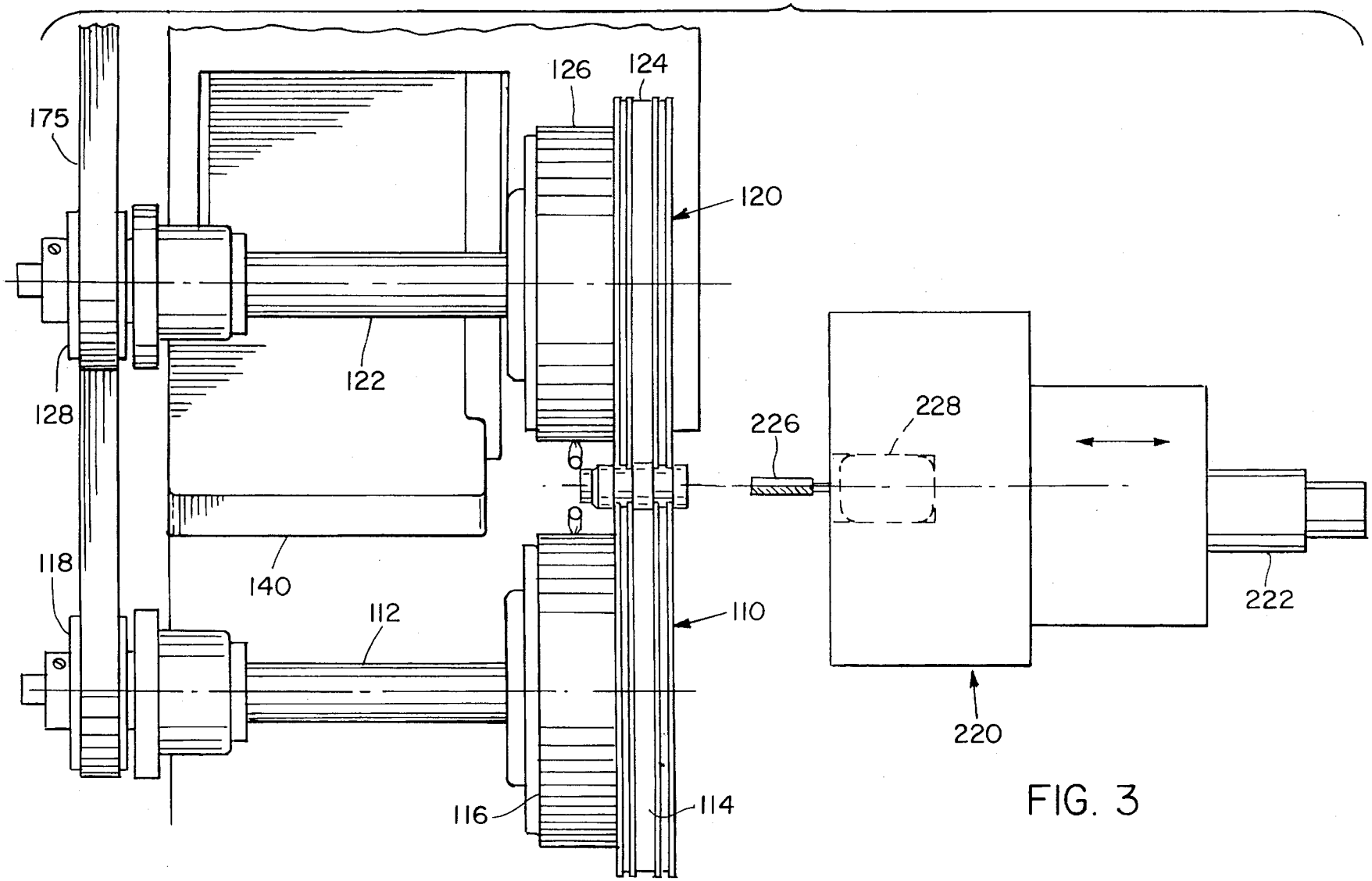
FIG. 3 is a schematic end view of the inventive grinding machine.

Turning to FIG. 3, each disk 110, 120 comprises the work surface 114, 124 that engages the outer circumferential surface of the workpiece 205. A reference ring 116, 126 is laterally adjacent to the work surface on each disk 110, 120. These reference rings 116, 126 are concentric with the work surfaces 114, 124 but have smaller outside diameters. Then, extending from each reference ring 116, 126 is the smaller diameter drive shaft 112, 122. Each drive shaft 112, 122 terminates in a belt pulley 118, 128.

Returning to FIG. 1, a drive belt 175 passes over the pulley 128 of the following disk 120 over an intervening pulley 180 and then over the pulley 118 of the stationary disk 110. The drive belt 175 is then driven by a drive pulley 185 which is connected to a motor 190. As a result, the following and stationary disks 120, 110 are counter rotating which respect to each other so that the workpiece 205 is rotated between them.

An inner surface of the workpiece 205 is machined by an X-Z grinder 220. This grinder 220 comprises an X-stage 224 and a Z-stage 222 so that a grinding head 226 is movable in two dimensions. A motor 228 drives the grinding head 226. During machining, the grinding head 226 is plunged into the revolving workpiece 205 by the actuation of the Z-stage 222 and then brought into engagement with the inner diameter of the workpiece 205 by actuating the X-stage 224. The revolving grinding head 226 contacts with the inner surface at a point opposite the shoe 165 so that the inner surface can be machined.

Figure 5:
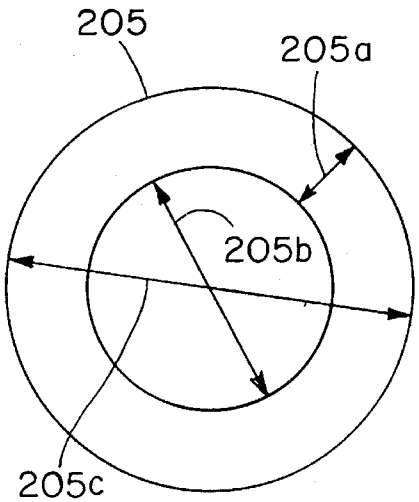
FIG. 5 shows the relevant dimensions of the workpiece.

The above-described grinding machine is very good at machining the wall thickness 205*a* of the workpiece 205 to very close tolerances, see FIG. 5, since the X-Z grinder 220 can very accurately and precisely position the grinding head 226 relative to the outer surface of the shoe 165. In applications in which the workpiece 205 is a valve lifter for an internal combustion engine, for example, the criticality lies in the inside diameter 205*b*, not the wall thickness. When the tolerances of the outside diameter 205*c* of the valve lifter are on the same order as the desired tolerances for the inside diameter 205*b* prior to machining, the desired tolerance for the inside diameter 205*b* can be achieved by regulating the wall thickness 205*a*. In many applications, however, the inside diameter 205*b* be ground to closer tolerances than the outside diameter 205*c*. In such applications where in-process gaging of the inside diameter is not an option due to space restrictions, conventional centerless grinding machines are unsuitable since inaccuracies in the outside diameter 205*c* will be transferred to the inside diameter 205*b*.

The present invention enables the accurate machining of the inside diameter 205*b* by first detecting the outside diameter 205*c* of the particular valve lifter. This is accomplished by detecting the displacement of the following disk 120 Since the position of the stationary disk 110 and the shoe 165 are essentially invariant, a larger or smaller part will cause corresponding vertical displacement of following disk 120 by the pivoting of the support arm 140. Detection of the displacement of the disk is accomplished by a proximity detector 230, which detects distances to the reference ring 126.

In one implementation, this proximity detector 230 is an air/electronic gaging system, which is commercially available through ETAMIC Corp of Plymouth, Mich. These gaging systems comprise a filtered pressurized air supply that is supplied into a reinforced measuring hose 232, which terminates in an air jet 234. The gaging system 230 and specifically the reinforced hoses 232 and air jet 234 are fixed to the lower frame 102. The air jet 234 is then placed in close proximity to the surface of the reference ring 126.

Figure 4:
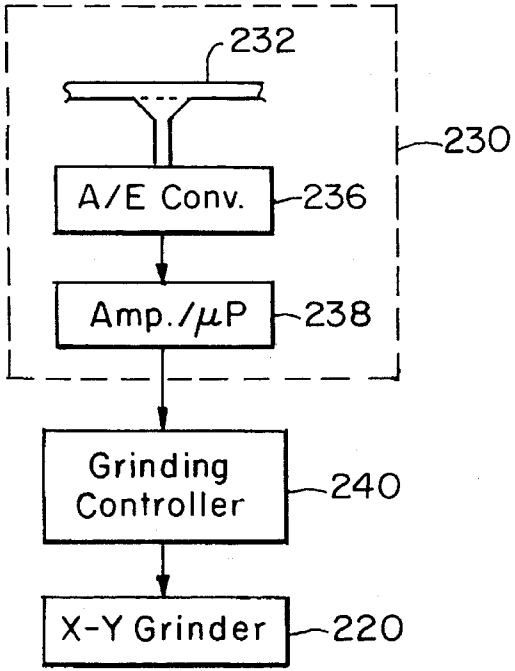
FIG. 4 shows a block diagrams of the control elements of the grinding machine.

As shown in FIG. 4, an air/electronic converter 236 detects the pressure in this reinforced hose 232 and generates an electronic signal indicative of that pressure. A microprocessor/amplifier 238 decodes this electronic signal to determine the distance between the air jet 234 and the reference ring 126. The resolution of such systems is approximately 0.000001 inches or 0.0001 millimeters.

The distance to the reference ring is related to the displacement of the following disk 120 and consequently the outside diameter 205*c* of the workpiece. Thus, a grinding controller 240 of the grinding machine calculates the wall thickness 205*a* of the particular workpiece 205 that will yield the desired inside diameter 205*b*. The grinding controller 240 then controls the X-Z grinder 220 to remove material from the inner wall of the workpiece 205 until the desired wall thickness, and thus inside diameter, is reached.

In the preferred embodiment, the displacement of the following disk 120 is detected dynamically as the following disk and the valve lifter 205 are rotated through a number of revolutions prior to any grinding. This is accomplished by determining the displacement of the following disk 120 while the disks are rotated. From this information, the grinding controller 240 determines the outside diameter as a function of its rotational position. Thus, a mean diameter of the workpiece 205 is calculated. Also, any eccentricities in the workpiece 205 can also be identified. Preferably, the readings of the proximity detectors 230 are made during two revolutions of the valve lifter. If it is determined that the not within diameter 205*c* of the valve lifter 205 is outside the tolerances, the valve lifter 205 can be rejected prior to any grinding. Also, if the eccentricities in the outside diameter 205*c* are so large as to negate the machining of the inside diameter 205*b* to the required tolerances, the valve lifter can also be rejected.

Figure 2:
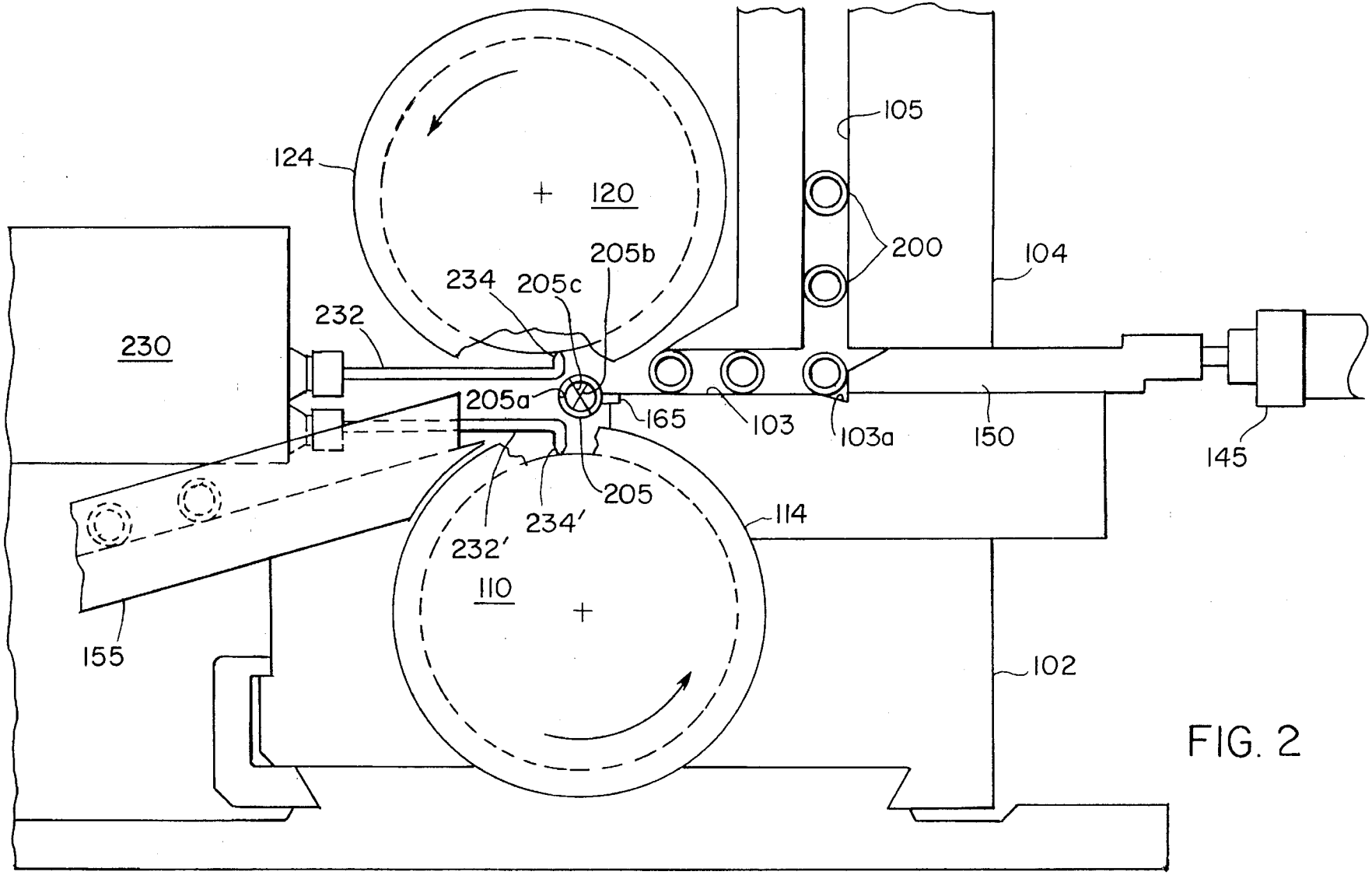
FIG. 2 is a side and partial cut-away view of the inventive grinding machine.

One modification shown in FIGS. 1 through 3 is the inclusion of a second reinforced measuring hose 232' that terminates in an air jet 234'. The two measuring hoses 232, 232' are then connected in a splitter, not shown. As a result, any displacement of the stationary disk 110 is additively combined with displacements of the following disk 120. Although the stationary disk will usually not move, it is adjustable within the grinding machines to adapt to differently sized workpieces. The inclusion of the second measuring hose 232' enables detection of changes in the adjustment of the stationary disk 110 and in-process compensation for these changes.

In other implementations, a single finger gage is used to measure the distance to the reference ring 126 of the following disk 120. These gages are contact-type proximity detectors in which a finger rides on a surface of the reference ring 126. By detecting the degree of depression of this finger, the displacement of the following disk 120 can be detected. With reference to FIG. 1, if proximity detector 230 were the finger gage instead of the air/electronic gaging system, the measuring hose 232 is replaced with a finger and the air jet 234 is replaced with the finger contact. Such gages are available through CONTROL GAGING, INC. of Ann Arbor, Mich. These gages provide digital read out and resolution to 0.00001 inches.

Figure 6:
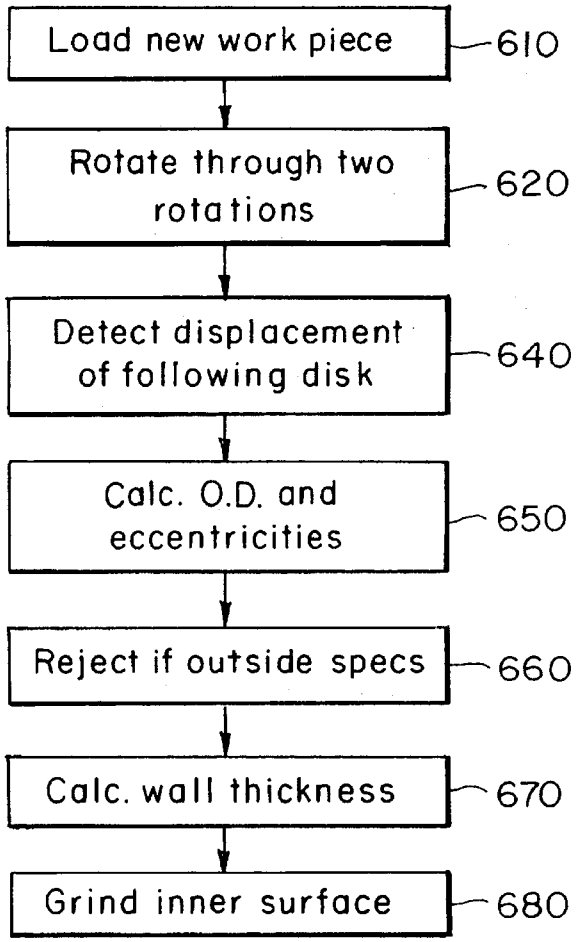
FIG. 6 illustrates an inventive process for controlling the grinding machine.

Finally, FIG. 6 illustrates a process for controlling the grinding machine. In step 610, a new workpiece 205 is loaded, and the finished workpiece ejected, by the activation of the ejector 150. Once the workpiece is proper seated between the following disk 120, stationary disk 110, and the shoe 165, the workpiece 205 is rotated through two rotations by operation of the motor 190, in step 620. In step 640, the displacement of following disk 120 is detected by the proximity detector 230. From the displacement of the following disk 120, the grinding controller 240 calculates the outside diameter 205*c* and eccentricities of the workpiece 205 in step 650. From the outside diameter calculations, the workpiece can be rejected if it is outside the tolerances for this dimension in step 660. If, however, the workpiece 205 is not rejected, the necessary wall thickness is calculated, in step 670, that will yield the desired inner diameter 205*b*. Finally, in step 680, the X-Z grinder 220 is operated to remove material along the inner surfaces of the workpiece to achieve the calculated wall thickness.

While this invention has been particularly shown and describe with references to preferred embodiments thereof, it will be understood by those skilled in the art that various changes in form and details may be made therein without departing from the spirit and scope of the invention as defined by the appended claims.

We claim:

1. A method for controlling a grinding machine including a disk for rotating a workpiece, a shoe for cooperating with the disk and a workpiece support element to hold the workpiece, and a grinder for grinding an inner surface of the workpiece during the rotation, the method comprising:

determining an outside diameter of the workpiece by detecting displacement of the disk;

calculating a necessary wall thickness that will yield the desired inner diameter; and operating the grinder to remove material along the inner surfaces of the workpiece to achieve the calculated wall thickness.

2. The method of claim 1 further comprising mechanically loading the disk to maintain engagement with the workpiece so that the workpiece is secured between an outer circumference of the disk, the shoe, and the workpiece support element.

3. The method of claim 1 further comprising sensing the displacement of the disk to determine the outside diameter.

4. The method of claim 1 further comprising providing a workpiece support element including a second disk for cooperating with the disk and the shoe to hold the workpiece.

5. A centerless grinding machine comprising:

a disk for rotating a workpiece having an outside surface and an inner surface;

a workpiece support element;

a shoe for cooperating with the disk and the workpiece support element to hold the workpiece;

a diameter detector that detects the outside surface of the workpiece and generates a detector signal;

a grinder that grinds the inner surface of the workpiece during rotation; and a controller that receives the detector signal and determines a wall thickness such that the grinder engages and grinds the inner surface in response to the detector signal from the diameter detector to provide a selected internal diameter of the workpiece.

6. The centerless grinding machine of claim 5, wherein the disk is mechanically loaded to maintain engagement with the workpiece so that the workpiece is secured between an outer circumference of the disk, the shoe, and the workpiece support element.

7. The centerless grinding machine of claim 6, wherein the diameter detector detects the outside diameter by sensing the displacement of the disk.

8. The centerless grinding machine of claim 5, wherein the controller controls the grinder to machine the inner surface of the workpiece to achieve a desired wall thickness which is determined in response to the outside diameter detected by the diameter detector.

9. The centerless grinding machine of claim 5, wherein the workpiece support element is another disk cooperating with the disk and the shoe to hold the workpiece.

10. The centerless grinding machine of claim 5, wherein the grinder comprises:

a grinding head;

a z-stage for plunging the grinding head into the workpiece; and an x-stage for bringing the grinding head into engagement with the inner surface of the workpiece.

11. A centerless grinding machine comprising:

a first disk that supports a workpiece having an outer surface and a grinding surface;

a following disk;

a shoe positioned relative to the first disk and the following disk, the shoe cooperating with the first disk and the following disk to hold and rotate the workpiece;

a diameter detector that detects the outside surface of the workpiece by detecting a displacement of the following disk by the workpiece, the detector generating a detector signal;

a grinder that grinds the grinding surface of the workpiece; and a controller electrically connected to the detector and the grinder that controls the grinder in response to the detector signal generated by the diameter detector.

12. The centerless grinding machine of claim 11, wherein the following disk is mechanically loaded to the bias towards the stationary disk and the shoe.

13. The centerless grinding machine of claim 11, wherein the controller controls the grinder to machine the inner surface of the workpiece to achieve a desired wall thickness which is determined in response to the outside diameter detected by the diameter detector.

14. The centerless grinding machine of claim 13, wherein the grinder comprises:

a grinding head;

a z-stage for plunging the grinding head into the workpiece; and an x-stage for bringing the grinding head into engagement with the inner surface of the workpiece.

15. A centerless grinding machine comprising:

a first stationary workpiece support element, a second stationary workpiece support element, and a following workpiece support element adapted to cooperate to hold and rotate a workpiece;

a diameter detector that detects an outside surface of the workpiece by detecting displacement of the following workpiece support element by the workpiece, the detector generating a measurement signal representative of the detected surface;

a grinder for grinding an inner surface of the workpiece during the rotation; and a controller electrically connected to the grinder to control grinding of the inner surface in response to the measurement signal received by the controller from the diameter detector such that the workpiece has a selected wall thickness.

16. The centerless grinding machine of claim 15, wherein the first and second stationary workpiece support elements are a stationary disk and a shoe, respectively.

17. The centerless grinding machine of claim 15, wherein the following workpiece support element is a following disk.

18. The centerless grinding machine of claim 15, wherein the following workpiece support element is mechanically loaded to maintain engagement with the workpiece so that the workpiece is secured between the first stationary workpiece support element, the second stationary workpiece support element, and the following workpiece support element.

19. The centerless grinding machine of claim 15, wherein the controller controls the grinder to machine the inner surface of the workpiece to achieve a desired wall thickness which is determined in response to the outside diameter detected by the diameter detector.

20. The centerless grinding machine of claim 15, wherein the grinder comprises:

a grinding head;

a motor for rotating the grinding head;

a z-stage for plunging the grinding head into the workpiece; and an x-stage for bringing the grinding head into engagement with the inner surface of the workpiece.

* * * * *